US006138870A

United States Patent [19]

Lin

[11] Patent Number: 6,138,870

[45] Date of Patent: Oct. 31, 2000

[54] TWO-CHAMBER MILKY LOTION BOTTLE

[76] Inventor: Rich Lin, 17F, No. 309, Sec.2, Wen Hua Rd., Panchiao, Taipei Hsien, Taiwan

[21] Appl. No.: 09/306,775

[22] Filed: May 7, 1999

[51] Int. Cl.[7] ..... B67D 5/60

[52] U.S. Cl. ..... 222/78; 222/131; 222/321.7; 40/406; 40/410; 428/13; 446/267

[58] Field of Search ..... 222/78, 130, 131, 222/321.7, 382, 383.1; 40/406, 410; 428/13; 446/267

[56] References Cited

U.S. PATENT DOCUMENTS

| | | | |
|---|---|---|---|
| 2,991,574 | 7/1961 | Ho et al. | 222/78 |
| 4,475,274 | 10/1984 | Beckstrom et al. | 222/562 |
| 5,291,674 | 3/1994 | Torrence | 40/410 |
| 6,065,640 | 5/2000 | Ho et al. | 222/78 |

*Primary Examiner*—Philippe Derakshani
*Attorney, Agent, or Firm*—Dougherty & Troxell

[57] ABSTRACT

A two-chamber milky lotion bottle is integrally molded from clear plastic material. An inner chamber of the milky lotion bottle is upward opened for containing an amount of milky lotion therein. An inner cap closes the inner chamber and an outer cap is screwed to an externally threaded top opening of the inner cap. A nozzle is associated with the outer cap with a nozzle head projected from the outer cap and a nozzle tube downward extended through the top opening of the inner cap and into the inner chamber. By depressing the nozzle head, milky lotion in the inner chamber is sucked upward via the nozzle tube for use. The outer chamber surrounds the inner chamber and has a downward opening. A bottom plate is connected to the downward opening of the outer chamber by heating seal, so that a dual-liquid ornament may be contained in the outer chamber, making the whole milky lotion bottle a good ornament at the same time.

3 Claims, 4 Drawing Sheets

TWO-CHAMBER MILKY LOTION BOTTLE

BACKGROUND OF THE INVENTION

The present invention relates to a two-chamber milky lotion bottle, and more particularly to an integrally molded milky lotion bottle having two separated chambers, namely, an inner and an outer chamber. The inner chamber is upward opened and can be closed with a cap for containing milky lotion therein, and the outer chamber is downward opened and can be closed with a bottom plate by means of heating seal to contain a dual-liquid and floating ornaments therein. The two-chamber milky lotion bottle can therefore serve as a good ornament.

A milky lotion bottle is a common container for domestic purpose and generally includes an externally threaded top opening for a cap to screw thereto and close the bottle. The cap usually has a compression nozzle associated with the top opening. By depressing a head portion of the compression nozzle, milky lotion in the bottle is sucked upward via a downward extended nozzle tube connected to the head portion. The milky lotion bottle may have many different designs. There is a milky lotion bottle having separated upper and lower chambers. A nozzle tube having an upper end connected to a threaded top opening of the bottle downward extends through a central zone of the bottle into the lower chamber. The upper chamber contains various kinds of ornaments for display. The lower chamber contains milky lotion for use. By depressing a nozzle head connected to the nozzle tube, milky lotion in the lower chamber is sucked upward and flows from the nozzle head for use. Such a two-chamber bottle is not easy to produce through integral injection molding and/or heating seal, and the narrow top opening of the bottle and the slender nozzle tube make the refilling of the bottle with milky lotion an uneasy work.

FIGS. 1 and 2 are perspective and sectional views, respectively, of a conventional two-chamber milky lotion bottle 10. As shown, the bottle 10 mainly includes an upper body 11, a middle partition 12, and a lower container 13. The upper body 11 has an externally threaded top opening 111 for a compression nozzle 20 to screw thereto, and a central through passage 112 downward extended from the threaded top opening 111. This is a known structure for almost all types of milky lotion bottles and mainly includes an outer cap 21 of the nozzle 20 for screwing to the threaded top opening 111 of the upper body 11, a nozzle head 22 at where the nozzle 20 is depressed, and a nozzle tube 23 downward extended from the nozzle head 22 into the lower container 13 via the central passage 112. Different dual-liquid ornaments 30 may be contained in the upper body 11, making the upper body 11 a good ornament. Milky lotion 40 is contained in the lower container 13 and can be sucked upward for use via the nozzle tube 23 by depressing the nozzle head 22.

Following are some of the disadvantages existing in the above-described two-chamber milky lotion bottle 10:

1. The central through passage 112 is so narrow that it is inconvenient for a user to refill the lower container 13 with milky lotion 40 via the threaded top opening 111.
2. The lower container 13 and the upper body 11 are connected to one another by heating seal with an annular heating sealed joint projecting from outer surface of the milky lotion bottle 10 that can be easily seen and makes the bottle 10 looking ugly.
3. The lower container 13 has a plug hole provided at outer surface thereof, so that the dual-liquid ornament 30 can be filled into the lower container 13 via the plug hole after the lower container 13, the partition 12, and the upper body 11 are connected by heating seal to form a complete bottle 10. The plug hole also adversely affects the appearance of the bottle 10.

It is therefore desirable to develop an improved two-chamber milky lotion bottle to eliminate the drawbacks existing in the conventional two-chamber milky lotion bottles.

SUMMARY OF THE INVENTION

A primary object of the present invention is to provide an improved two-chamber milky lotion bottle that is integrally formed from clear plastic material by injection molding and includes an inner chamber and an outer chamber. The inner chamber is an upward opened tubular container and is sealed with an inner cap by heating seal. The outer chamber is a downward opened annular container surrounding the inner chamber and is closed with a bottom plate by heating seal. Milky lotion is contained in the inner chamber while a dual-liquid ornament is contained in the outer chamber, making the whole milky lotion bottle a good ornament.

Another object of the present invention is to provide an improved integrally molded milky lotion bottle including an inner chamber for containing milky lotion and an outer chamber for containing a dual-liquid ornament. The inner chamber has proper diameter and volume and has a semi-spherical bottom end, so that an adequate amount of milky lotion can be contained therein. A colored milky lotion can even serve as a good background for the dual-liquid ornament in the outer chamber to create even better decorative effect.

DETAILED DESCRIPTION OF THE PREFERRED EMBODIMENTS

Figure 1:
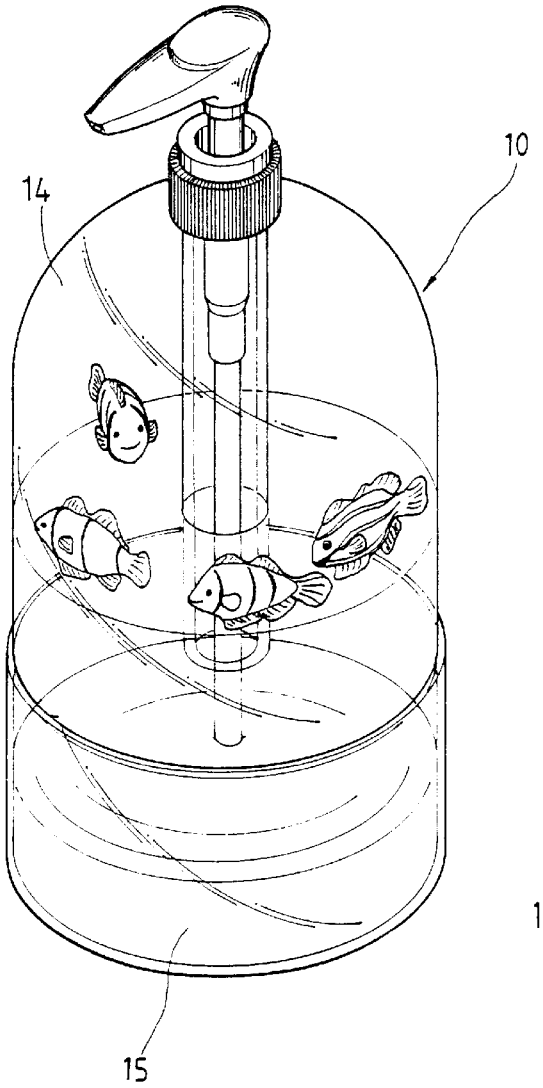
FIG. 1 (Prior Art)
FIG. 1 is a perspective of a conventional two-chamber milky lotion bottle.
Figure 2:
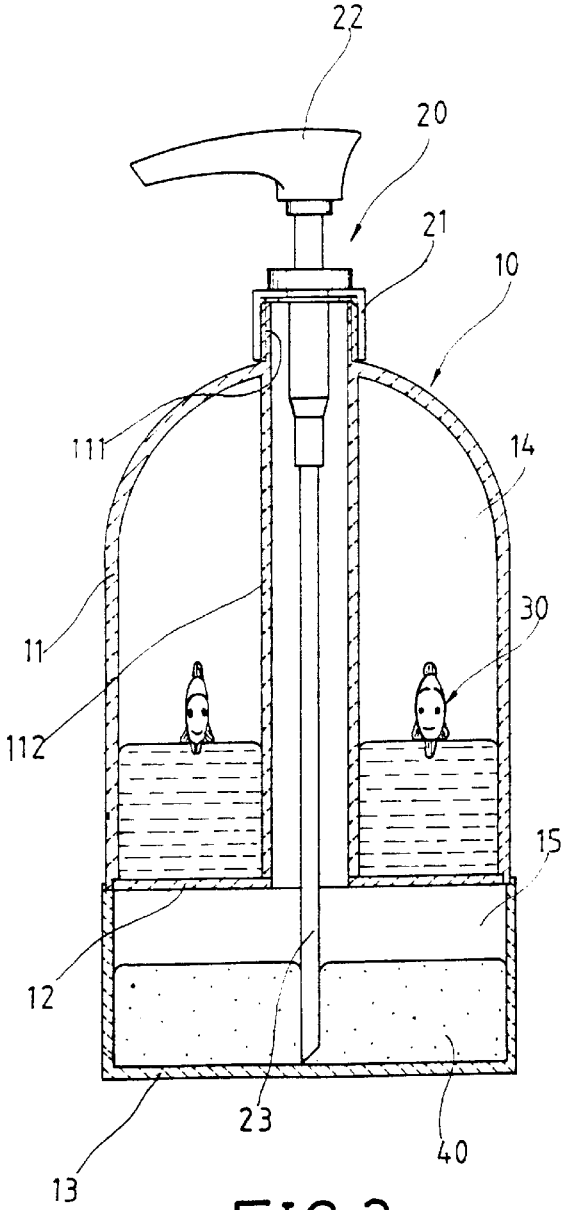
FIG. 2 (Prior Art)
FIG. 2 is a vertical sectional view of the two-chamber milky lotion bottle of FIG. 1.
Figure 3:
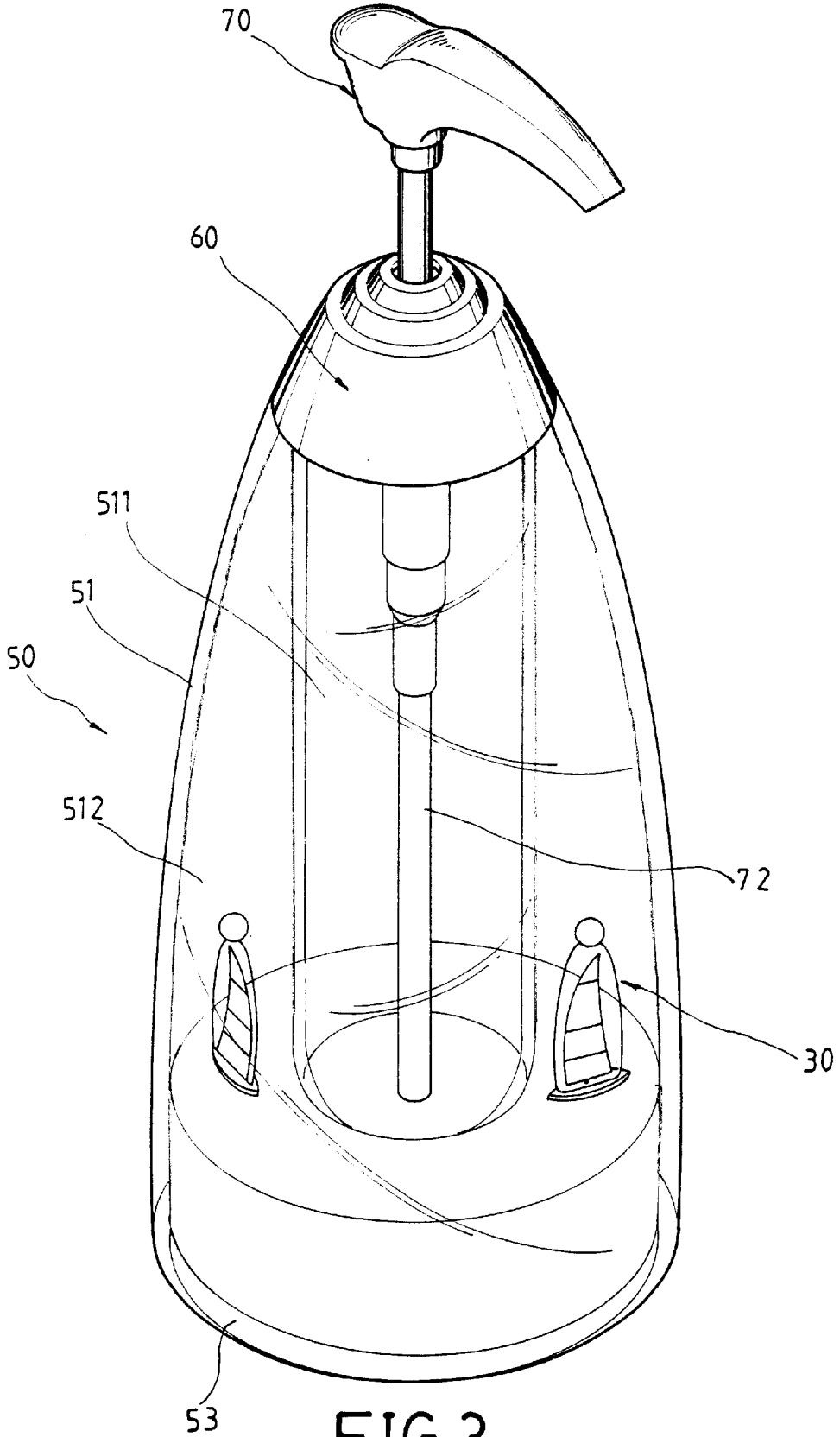
FIG. 3 is a perspective of a two-chamber milky lotion bottle according to a preferred embodiment of the present invention.
Figure 4:
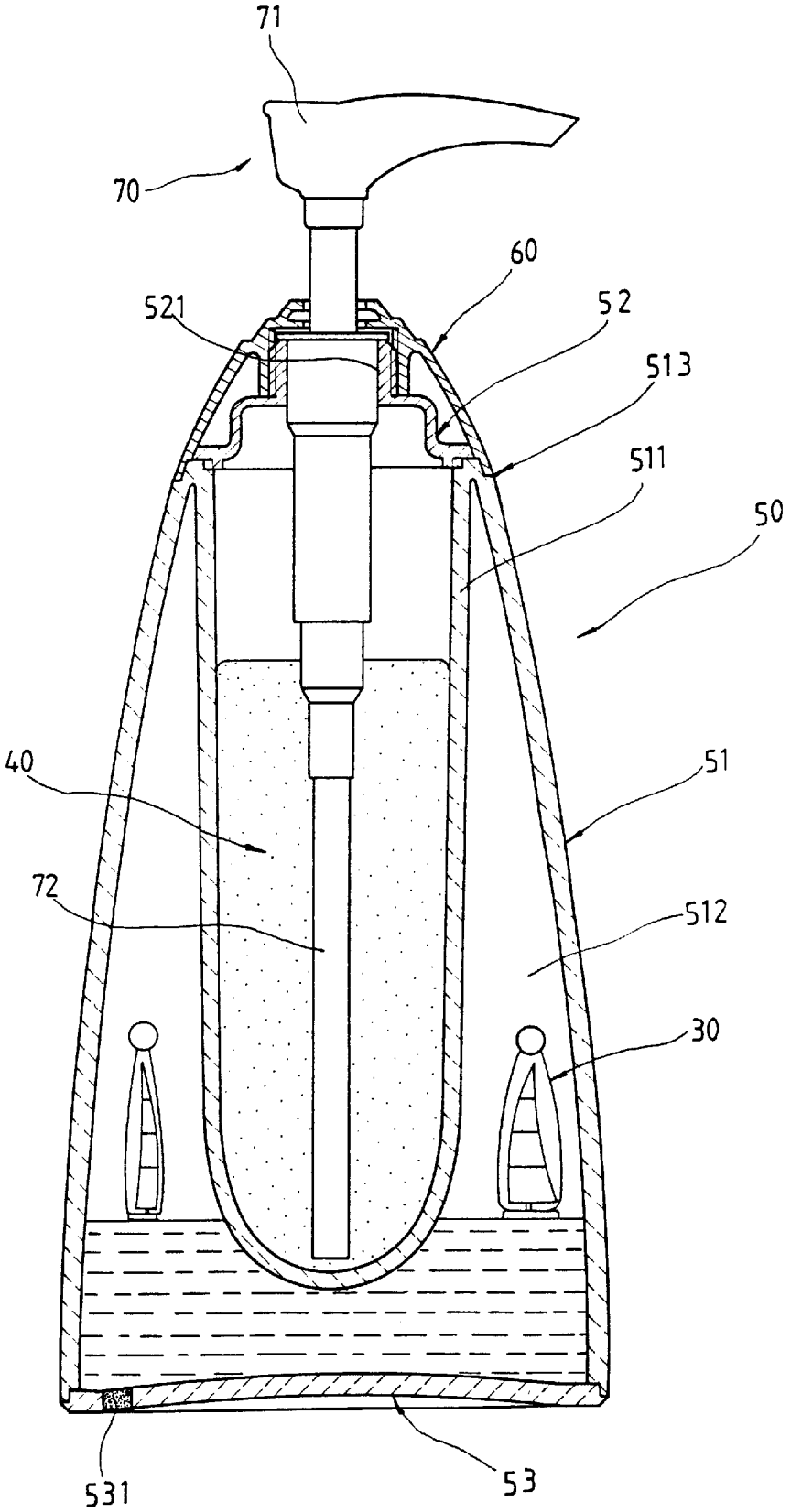
FIG. 4 is a vertical sectional view of the two-chamber milky lotion bottle of FIG. 3.
Figure 5:
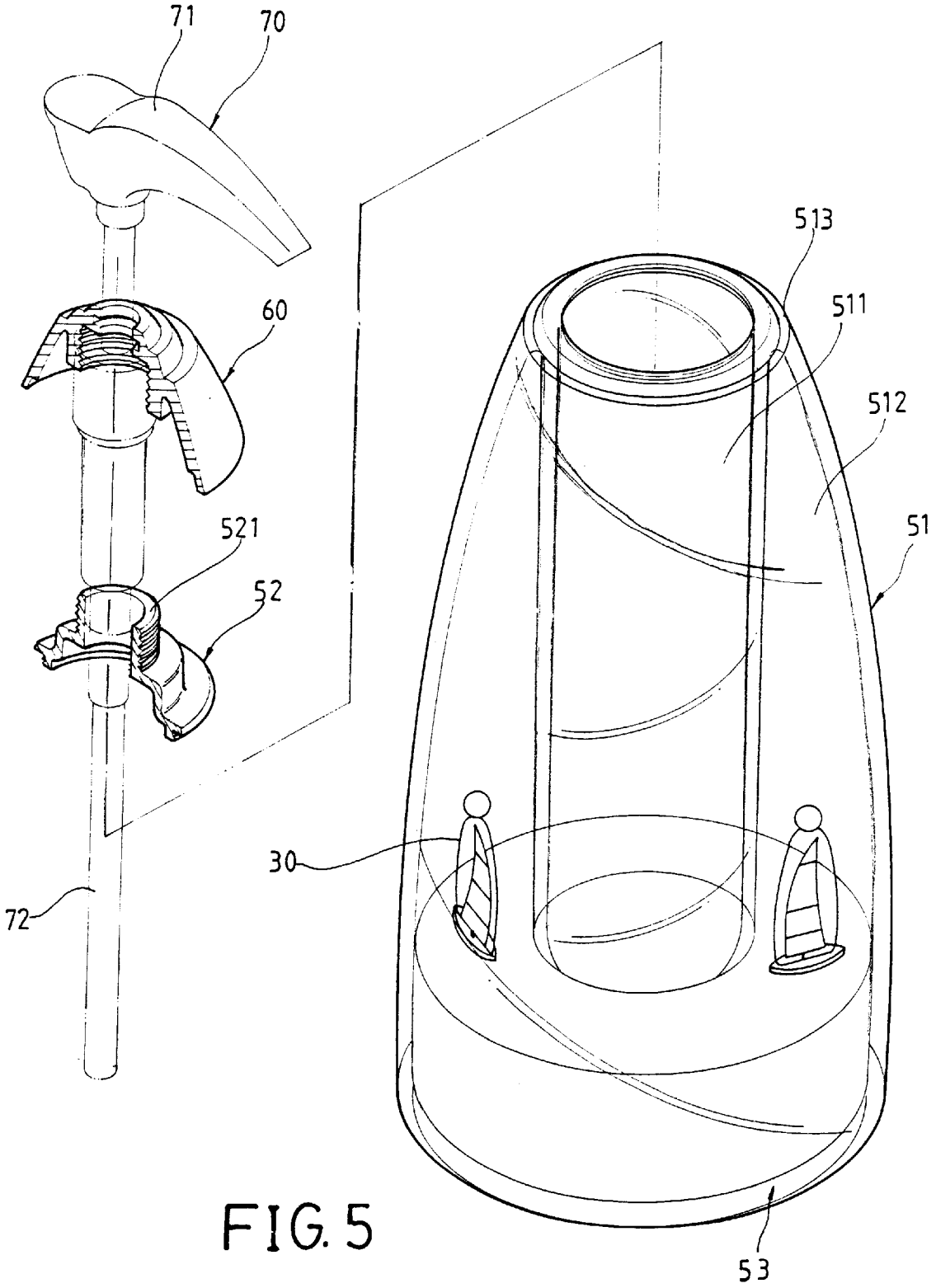
FIG. 5 is an exploded perspective of the two-chamber milky lotion bottle of FIG. 3.

Please refer to FIGS. 3, 4 and 5. A two-chamber milky lotion bottle 50 according to a preferred embodiment of the present invention mainly includes a main bottle 51, an inner cap 52, and a bottom plate 53.

The main bottle 51 is integrally molded from clear plastic material and includes a centered tubular inner chamber 511 and an annular outer chamber 512 surrounding the inner chamber 511.

The inner chamber 511 is upward opened and defines a predetermined volume for containing an amount of milky lotion 40 therein. The inner chamber 511 preferably has a semi-spherical bottom end. The inner cap 52 is connected to an opened upper end of the inner chamber 51 by heating seal. The inner cap 52 has an externally threaded opening 521 provided at a top center thereof for an outer cap 60 to screw thereto. The outer cap 60 associates with a suitable compression nozzle 70 that downward extends through the opening 521 of the inner cap 52 and into the tubular inner chamber 511. The nozzle 70 is a commercially available standardized product and is therefore not described in details herein.

The main bottle 51 is formed around an outer periphery of its upper edge with a shoulder portion 513, such that an outer surface of the outer cap 60 flushes with an outer surface of the main bottle 51 after the outer cap 60 is screwed to the opening 521 of the inner cap 52. Whereby when a head portion 71 of the nozzle 70 is depressed, milky lotion 40 contained in the inner chamber 511 is sucked upward for use via a nozzle tube 72 extended from a lower end of the nozzle 70 into the inner chamber 511.

The annular outer chamber 512 has a downward opening that is closed with the bottom plate 53 by means of heating seal, so that the outer chamber 512 provides a close space in which decorative articles, such as a dual-liquid ornament 30, can be contained. The bottom plate 53 is provided with a plug hole 531 via which the dual-liquid ornament (including oil and water) can be supplied into the outer chamber 512. The plug hole 531 can be tightly closed with a plug after the outer chamber 512 has been duly filled with the dual-liquid ornament 30.

Since the main bottle 51 is made of clear material, the dual-liquid ornament 30 in the outer chamber 512 can be easily viewed from any direction. The outer chamber 512 with the dual-liquid ornament 30 therefore makes the milky lotion bottle 50 an excellent decoration. Moreover, the inner chamber 511 has expanded diameter below the externally threaded opening 521 and therefore allows a user to refill the inner chamber 511 with milky lotion 40 more easily and more conveniently. When the inner chamber 511 contains colored milky lotion 40, the semi-spherical bottom end of the inner chamber 511 enables the inner chamber 511 completely enclosed by the outer chamber 512 to serve as a good decorative background for the dual-liquid ornament 30 in the outer chamber 512.

What is claimed is:

1. A two-chamber milky lotion bottle comprising a main bottle, an inner cap, an outer cap, and a bottom plate;

said main bottle being integrally molded from clear plastic material and including an inner chamber and an outer chamber, said inner chamber being an upward opened tubular chamber defining a top opening and a predetermined volume for containing an amount of milky lotion therein, said outer chamber being a downward opened annular chamber surrounding said inner chamber and defining a bottom opening for containing a dual-liquid ornament;

said inner cap being connected to an upper edge of said top opening of said inner chamber by means of heating seal and having an externally threaded opening centered at a top of said inner cap, said externally threaded opening having an inner diameter smaller than that of said inner chamber;

said outer cap being screwed to said externally threaded opening of said inner cap, said outer cap being associated with a compression nozzle that has a head portion projected from said outer cap and a nozzle tube downward extending through said central opening of said inner cap and into said inner chamber; and said bottom plate being connected to said bottom opening of said outer chamber by heating seal so as to close said outer chamber to provide a close space therein, and said bottom plate being provided with a plug hole via which said dual-liquid ornament is supplied into said close space in said outer chamber;

whereby when said head portion of said compression nozzle above said outer cap is depressed, said milky lotion contained in said inner chamber of said main bottle is sucked upward via said nozzle tube for use, and said dual-liquid ornament contained in said outer chamber can be easily viewed from any direction and forms an excellent decoration.

2. A two-chamber milky lotion bottle as claimed in claim 1, wherein said inner chamber of said main bottle preferably has a semi-spherical bottom end.

3. A two-chamber milky lotion bottle as claimed in claim 1, wherein said main bottle is provided a round an outer periphery of its upper edge with a shoulder portion, such that an outer surface of said outer cap flushes with an outer connected to said main bottle around said shoulder portion.

* * * * *